United States Patent [19]

Dixon

[11] Patent Number: 4,469,129

[45] Date of Patent: Sep. 4, 1984

[54] ABOVE GROUND GASOLINE STORAGE APPARATUS

[76] Inventor: John W. Dixon, 9870 Fairmount Rd., Newbury, Ohio 44065

[21] Appl. No.: 370,824

[22] Filed: Apr. 22, 1982

Related U.S. Application Data

[63] Continuation of Ser. No. 174,857, Aug. 4, 1980, abandoned, which is a continuation-in-part of Ser. No. 023,725, Mar. 26, 1979, abandoned.

[51] Int. Cl.[3] ..... B65D 25/18; F16K 24/00; F17C 3/02

[52] U.S. Cl. ..... 137/587; 220/88 R; 220/428; 220/902

[58] Field of Search ..... 220/88 R, 88 A, 901, 220/455, 428, 437, 438, 439, 902, 445; 206/591; 296/1 R, 189, 188; 280/5 R, 5 G, 5 D, 5 E, 5 F; 137/587, 264, 375

[56] References Cited

U.S. PATENT DOCUMENTS

| | | | |
|---|---|---|---|
| 64,123 | 4/1867 | McGarry | 220/428 X |
| 308,948 | 12/1884 | Bruce | 220/428 |
| 1,130,988 | 3/1915 | Lape | 220/428 |
| 1,689,917 | 10/1928 | Geisinger | 220/426 X |
| 1,779,786 | 10/1930 | Unzue | 220/428 |
| 1,856,399 | 5/1932 | Philips | 280/5 D |
| 1,940,277 | 12/1933 | Stresan | 220/439 |
| 1,950,234 | 3/1934 | Ewertz | 220/428 |
| 1,989,940 | 2/1935 | McGanghan et al. | 280/5 E X |
| 2,285,830 | 6/1942 | Paget | 220/88 R X |
| 2,558,694 | 6/1951 | Speis | 220/428 |
| 2,577,171 | 12/1951 | Wiggin et al. | 220/437 |
| 2,687,618 | 8/1954 | Bergstrom | 220/88 R |
| 2,928,535 | 3/1960 | Simmons et al. | 206/591 X |
| 2,928,536 | 3/1960 | Weaver, Jr. et al. | 206/591 X |
| 2,929,221 | 3/1960 | Clanson | 220/426 X |
| 2,931,211 | 4/1960 | McCullough | 220/455 X |
| 3,044,607 | 7/1962 | Hopper | 206/591 X |
| 3,129,836 | 4/1964 | Frevel | 206/591 X |
| 3,163,313 | 12/1964 | Reynolds et al. | 220/437 X |
| 3,583,592 | 6/1971 | Kerfman | 220/426 |
| 3,895,152 | 7/1975 | Carlson et al. | 220/444 X |

OTHER PUBLICATIONS

"Petroleum Marketer", Nov.-Dec. 1974, pp. 8-10, Article on Portable Gas Stations.

*Primary Examiner*—Allan N. Shoap
*Attorney, Agent, or Firm*—Oldham, Oldham, Hudak, Weber & Sand, Co.

[57] ABSTRACT

The apparatus includes an insulated inner compartment member, an outer compartment member completely enclosing and spaced from the inner compartment member, with both of the members being liquid tight and with non-inflammable liquid being positioned in the space between the members and completely covering the inner compartment member, the inner compartment member being supported only at its upper end by the outer compartment member. Filling and discharge means connect to the inner compartment member from outside of the apparatus to complete the storage device.

3 Claims, 2 Drawing Figures

ABOVE GROUND GASOLINE STORAGE APPARATUS

CROSS-REFERENCE

Figure 1:
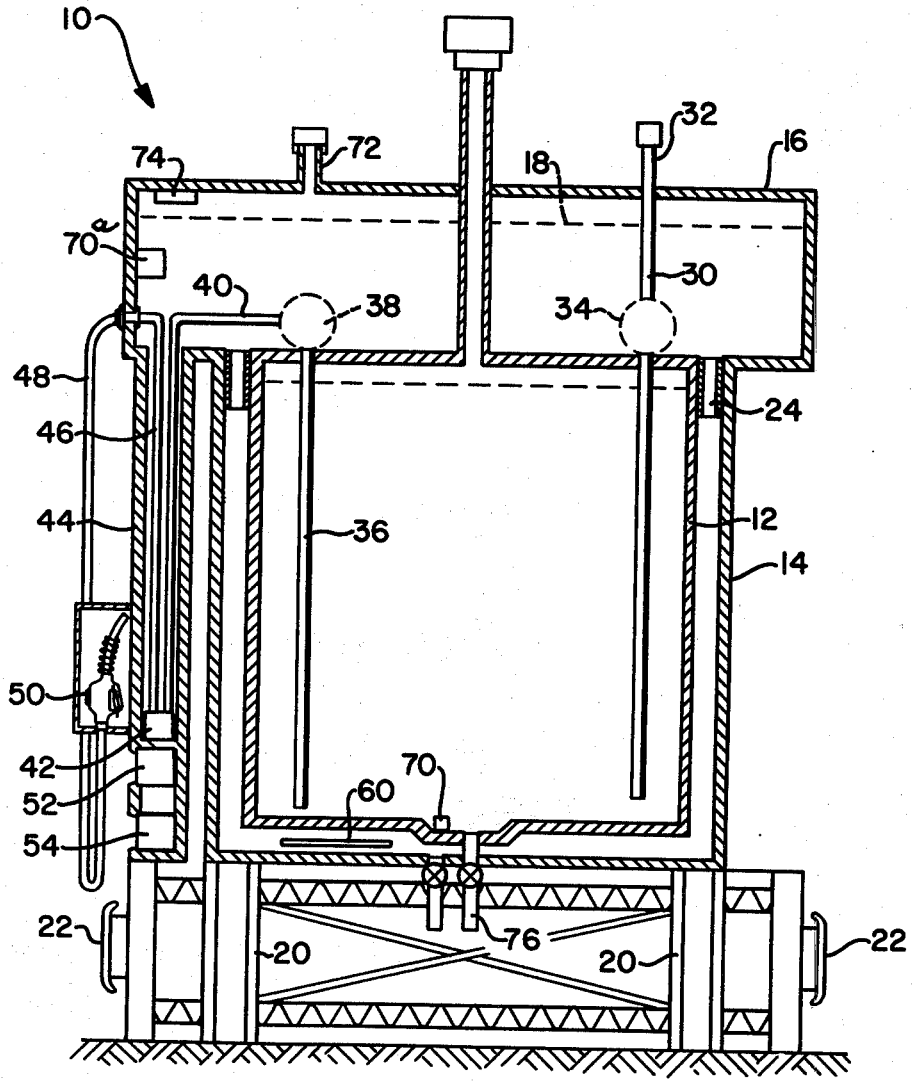

This is a continuation application of my prior application, Ser. No. 174,857, filed on Aug. 4, 1980, now abandoned, and entitled "ABOVE GROUND GASOLINE STORAGE APPARATUS" which in turn is a continuation-in-part application of my prior application Ser. No. 023,725 filed on Mar. 26, 1979, now abandoned.

BACKGROUND ART

The present invention relates to double wall units forming separate inner and outer compartments for storage of inflammable liquids, such as gasoline, above ground. Heretofore, there have been many different structures proposed for storage of inflammable liquids below ground, and a variety of structures have been proposed for transport and/or storage of inflammable liquids above ground. In storing inflammable liquids above ground, it is essential that controls be provided re any possible leakage of the liquid from one or both of the tanks; the vapors from the stored inflammable liquid, such as gasoline, must be vented from the tanks or be otherwise handled in a safe manner; the structure must be as fireproof as possible and be resistant to impacts; and gradual deterioration of the structure must be observable. Also, the structure should be difficult to damage by vandalism, and the structure should be earthquake proof, if possible.

Efforts have been made in the past to provide a unitary gasoline storage and vending apparatus that can be moved from place to place, as desired, for vending of gasoline. The possibility of automatic vending of gasoline from a storage tank unit at a remote area, or during the night when other gas stations or suppliers would be closed, provide interesting commercial possibilities for use of self-contained gasoline storage and vending units. These units particularly lend themselves to above ground storage of gasoline.

A number of different patented constructions have been proposed for storage of liquids, and they include U.S. Pat. Nos. 1,453,983 and 2,558,694. It still is very desirable to provide an improved above ground storage facility for gasoline, which facility is safe in construction and use, is durable, and would provide a mobile gasoline storage and vending unit.

DISCLOSURE OF INVENTION

The general object of the present invention is to provide a novel, improved, above-ground storage apparatus or tank for storing gasoline and other inflammable liquids, and wherein the apparatus is characterized by the provision of two separate compartments comprising a specially insulated inner compartment, an outer compartment completely enclosing the inner compartment, and a wall of water completely enclosing the inner compartment or tank.

Another object of the invention is to provide a novel and improved storage apparatus for inflammable liquids, wherein the apparatus is particularly set up to handle any leakage of inflammable liquid from the inner container in a safe manner, and where the inner tank is supported by and secured to the outer tank at only one top area.

Another object of the invention is to provide an above-ground storage system for inflammable liquids, wherein a complete movable gasoline storage apparatus and dispensing apparatus has been provided, wherein the apparatus is lower in cost than the below ground installations; and which is relatively easy to maintain and be transferred from one location to another to permit flexibility in a gasoline storage and/or vending system.

Other objects of the invention are to provide an inflammable liquid storage apparatus that has good insulated walls and roof structures, that permits a certain freedom of movement of the inner container in relation to the outer container, that has provision for escape of vapor from the apparatus; wherein the structure is fire resistant; where the temperature stability of the gasoline is relatively high; and where the construction is collision resistant or protected from damage by or from collision of vehicles with the apparatus; to provide for means supplying inflammable liquids to the inner tank; to provide means for dispensing liquids from the inner tank in a substantially conventional manner; to provide for heating outer tanks, or to use any suitable antifreeze mixture in the apparatus of the invention.

Figure 2:
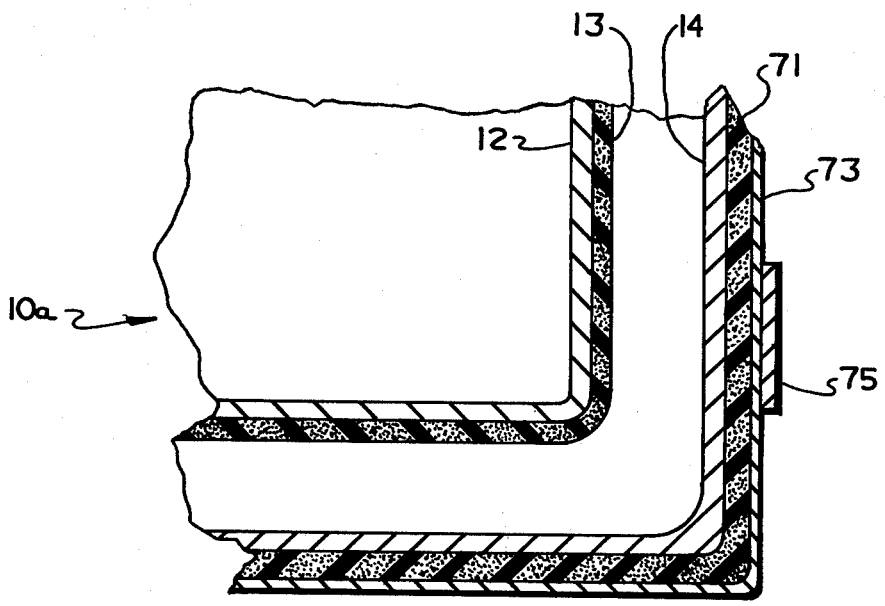

FIG. 1 of the drawings is a diagrammatic vertical cross section of one typical apparatus embodying the principles of the invention and with the components thereof being shown somewhat schematically; and FIG. 2 is an enlarged section of a portion of the wall of a modification of the invention.

When referring to corresponding members shown in the drawings and referred to in the specification, corresponding numerals are used to facilitate comparison therebetween.

BEST MODE FOR CARRYING OUT THE INVENTION

The above-ground storage apparatus for gasoline provided by the invention, has as one embodiment thereof, the provision of a structure comprising an inner compartment member having a layer of closed cell insulation on its outer wall, and outer compartment member supporting the inner compartment member from the top thereof and completely enclosing but spaced from the inner compartment member, both of these members being liquid tight and with a non-flammable liquid received in the space between the members and completely covering the inner member in normal operating conditions, and filling and discharge means connecting to the inner compartment member from outside of the apparatus for flow of gasoline to and from the inner compartment member.

Above-ground storage apparatus for gasoline or similar inflammable liquids is indicated as a whole by the numeral 10. This apparatus 10 primarily comprises an inner compartment means or member 12 and an outer compartment member 14 which completely encloses the inner compartment member and is spaced therefrom. Both of these members normally are made from metal and are liquid tight. It is important that at least the outer vertical walls of the inner compartment 12 be completely covered by a continuous body or layer 13 of closed cell insulation such as "Foamglas" made by Pittsburgh Corning Glass Company.

It should be noted that the outer compartment member 14 is of different shape than the inner compartment member and it includes a top section 16 which protrudes appreciably above the top of the inner compartment 12 whereas other walls of the outer compartment member may be relatively closely spaced from the inner compartment member. In use of the apparatus of the invention, a non-flammable liquid, such as water 18, is provided in the space between the inner and outer compartment members and with the water extending up into the top section 16 to substantially fill the same. This water enclosing the inner compartment 12 sets up some slight pressure thereon by the pressure head of water extending above the top of the inner compartment.

Any suitable base 20 is provided for the unit formed from the outer and inner compartment members and with the outer compartment member 14 being suitably secured thereto in any desired manner. The base may have crash bumpers 22 or any other equivalent means provided on laterally outer portions thereof to avoid damage thereto by any vehicle accidentally bumping into this base 20. Or, the tank could be on the ground with a crash protector ring around it.

In order to position the inner member 12 in spaced relation to the outer member 14, any suitable support means are provided for the inner compartment member to secure the same to the outer compartment member and, hence, brackets or attaching devices 24 are, for example, welded to and extend between adjacent walls of the inner and outer compartment members. Any suitable number of these brackets 24 are provided in satisfactory spaced circumferential relationships to each other so as to position the inner compartment member in relation to the outer member and support it thereon, but yet permit some movement of the lower portion of the inner container re the outer container. The brackets 24 are at the upper end of the member 12 to form the only fixed connection between the members. Usually, a filling pipe 30 is provided in the top section 16 and it extends down into the inner member 12 to a point near the bottom thereof and a removable cap 32 is suitably secured to the upper end of this filling pipe. If required, a suitably positioned filling pump 34 is provided and connected to this filling pipe 30 for drawing or forcing gasoline or other liquid down into the inner member for storage therein. The pump has any usual controls provided therefor and extending from the apparatus 10 to a point on the external portion thereof to control the filling action, if required. Or, merely gravity flow of liquid into the inner compartment member 12 can be provided through the filling pipe 30.

For delivery purposes, a delivery pipe 36 extends down into the inner compartment member 12 from the top thereof and a delivery pump 38 may be secured to the top portion of the inner compartment member 12, or be otherwise positioned. Such pump 38 has external controls provided therefor and it will draw gasoline or liquid up from the inner member for delivery through an exhaust pipe or discharge pipe 40 extending downwardly from a point adjacent the pump 38 so that the gasoline or liquid will pass through a flow meter 42 for volume recording action. Or, if desired, this discharge pipe 40 may just connect to any suitable external means and/or power source for delivery of the gasoline to such external point. If a metered discharge action is desired, then the flow meter 42 should be provided and preferably this is positioned within an enclosure section 44 that may be formed as a unit with the top section 16 to depend downwardly therefrom immediately adjacent a side of the outer compartment member 14. The liquid flowing from the flow meter 42 is shown as preferably passing upwardly through a further discharge pipe 46 to a point external of the outer compartment and where, for example, a flexible discharge hose 48 can be suitably coupled to a discharge end of the pipe 46. This discharge hose 48 normally has a conventional nozzel 50 provided at the end thereof and it is conventionally engaged with a portion of the section 44 for normal inoperative storage thereof.

Now, if a completely independent or automatic liquid discharge action is desired for dispensing and selling gasoline, for example, then the flow meter 42 would have a price computer 52 operatively connected thereto and a known type of a credit control device 54 may then be operatively coupled to the computer 52 which, in turn, is operated through the flow meter 42 so that a metered quantity of material will be vended depending upon the arrangement and operation of the credit control device 54, and actuation thereof by a prospective purchaser.

In use of the apparatus of the invention, an electrical heater device 60 can be positioned between the inner and outer compartment members to maintain the water received in the space therebetween above freezing and any conventional control could connect to this heater 60 and extend to a point remote therefrom for supply of energy thereto and for controlling the heating action. A suitable control thermostat may be provided and the heater may be in the gasoline. Or, if desired, any suitable antifreeze material can be added to the liquid or water 18 received between the members 12 and 14. Possibly if no freezing action can be anticipated, then no heating action or antifreeze might be required.

Should any leak develop in the inner compartment member 12, any water collecting within the inner member would by gravity collect in the bottom of this inner compartment member. Hence, a conventional water sensor 70 normally is positioned in a base portion of the inner member 12 in a recessed bottom area thereof wherein the water would tend to collect. Hence, when a predetermined volume of water would collect in this area, the water sensor device would be actuated and provide an external signal to indicate the leakage problem and that some servicing action should be taken.

A thermostat 70*a* can be positioned in the top section of the outer member, if desired, to aid in controlling the action of the electric heater device 60 provided in the lower portion of the apparatus and conventional circuit means interconnect these two for unitary action.

Normally, it is desirable to provide a suitable air or water vapor vent for the top section of the apparatus and this would communicate with the space between the members 12 and 14 so that a top vent 72 is provided in the apparatus and connects to the space between the members to permit air and vapor venting action. Also, it may be desired to provide an indicator of the vapor content in the apparatus so that a vapor sensor 74 may also be provided within the outer member 14 in the space between the two members to aid in sensing the vapor content in such space to indicate whether water is required or not in the apparatus; and, also, to check for leakage of gasoline and/or water.

Any conventional means can connect to the space between the compartments 12 and 14 for supply of replacement water to this space so as to maintain the desired water level therein.

Obviously, any suitable access openings can be provided for the top section 16 or any other portion of the apparatus, as desired. Likewise, the members 12 and 14 can be of any desired shape and they are shown of substantially square shape in section.

FIG. 2 shows that an insulation layer 71 may be adhesively secured to the outer walls of the outer compartment member 14, and it would preferably also be of "Foamglass" or similar material. If desired, a stainless steel skin 73 and retainer bands 75 cover the insulation layer 71 and aid in retaining it in position. Also, the skin 73 would protect the insulation from exposure to direct flames and from thermal shock. The inner container 12*a* at its base is quite close to the outer container 14*a*. The apparatus 10*a* can be mounted on any suitable support or the ground. The coolant liquid would not need to be circulated at the bottom of the apparatus if it is positioned on the ground. Also, the insulation layer 71 can be omitted on the bottom of the apparatus when it rests on the ground.

The enlarged top section 16 provides excess water in case any boiling of the coolant liquid occurs, and this enhances the protection of the stored liquid.

While one complete embodiment of the invention has been disclosed herein, it will be appreciated that modification of this particular embodiment of the invention may be resorted to without departing from the scope of the invention.

What is claimed is:

1. An above ground storage apparatus for a dangerous liquid comprising an inner compartment having impervious top and side wall portions defining a chamber for receiving the dangerous liquid, a layer of closed cell insulation material secured to and covering a surface of said side wall portion of said inner compartment, an outer compartment having top and side wall portions enclosing the respective top and side portions of said inner compartment and spaced therefrom, a body of non flammable aqueous liquid confined in the space between said inner and outer compartments, said body of non flammable aqueous liquid surrounding the side wall portion of said inner compartment and being in heat transfer relationship with said insulation layer covering said surface of said side wall portion of said inner compartment, first vapor vent means provided in the outer compartment and disposed above the body of non flammable liquid for venting vapor from said outer compartment to the atmosphere, second vapor vent means provided in the inner compartment and disposed above the dangerous liquid for venting vapor from said inner compartment to the atmosphere, said body of aqueous liquid being confined as a normally static body in the space between said inner and outer compartments so that the body of aqueous liquid dissipates heat essentially by absorption and evaporation in the space between the outer and inner compartments, said first vapor vent means venting vapors resulting from evaporation of said aqueous non flammable liquid to the atmosphere while said body of non flammable aqueous liquid is evaporating and said second vent means venting any vapor resulting from evaporation of the dangerous liquid in the inner comporatment to the atmosphere, said body of non flammable aqueous liquid limiting the heat transferred to the closed cell insulation on the inner compartment while said body of non flammable aqueous liquid is evaporating, and said closed cell insulation further limiting transfer of heat from said body of non flammable aqueous liquid to said dangerous liquid in said inner compartment.

2. An above ground storage apparatus as defined in claim 1, further including a layer of insulation surrounding the side wall portion of said outer compartment.

3. An above ground storage apparatus as defined in claim 1, wherein said outer compartment is adapted to rest on the ground.

* * * * *